US007631619B2

(12) United States Patent
Bangert et al.

(10) Patent No.: US 7,631,619 B2
(45) Date of Patent: Dec. 15, 2009

(54) COOLING AGENT COMPENSATION TANK FOR A COOLING CIRCUIT

(75) Inventors: Boris Bangert, Stuttgart (DE); Reinhard Heine, Leutenbach (DE); Eberhard Pantow, Möglingen (DE); Brigitte Taxis-Reischl, Stuttgart (DE)

(73) Assignee: Behr GmbH & Co. KG, Stuttgart (DE)

( * ) Notice: Subject to any disclaimer, the term of this patent is extended or adjusted under 35 U.S.C. 154(b) by 90 days.

(21) Appl. No.: 11/814,728

(22) PCT Filed: Jan. 12, 2006

(86) PCT No.: PCT/EP2006/000203

§ 371 (c)(1),
(2), (4) Date: Nov. 2, 2007

(87) PCT Pub. No.: WO2006/081920

PCT Pub. Date: Aug. 10, 2006

(65) Prior Publication Data

US 2008/0190385 A1 Aug. 14, 2008

(30) Foreign Application Priority Data

Jan. 31, 2005 (DE) ..... 10 2005 004 518

(51) Int. Cl.
*F01P 3/22* (2006.01)

(52) U.S. Cl. ..... 123/41.54; 165/104.32

(58) Field of Classification Search ..... 123/41.01, 123/41.43, 41.51, 41.54; 165/104.32
See application file for complete search history.

(56) References Cited

U.S. PATENT DOCUMENTS

| | | | |
|---|---|---|---|
| 3,051,450 | A | 4/1962 | White at al. |
| 3,195,294 | A | 7/1965 | Verdura at al. |
| 5,666,911 | A | 9/1997 | Gohl et al. |
| 6,059,019 | A | 5/2000 | Brost et al. |

FOREIGN PATENT DOCUMENTS

| | | |
|---|---|---|
| DE | 197 31 999 | 2/1999 |
| DE | 100 14 743 | 10/2001 |
| DE | 100 18 001 | 10/2001 |
| DE | 100 54 491 | 5/2002 |
| DE | 102 31 480 | 1/2004 |
| EP | 0 370 234 | 5/1990 |
| EP | 0 561 673 | 9/1993 |
| FR | 2 579 668 | 10/1986 |
| GB | 473483 A | 10/1937 |
| WO | WO 80/00863 | 5/1980 |

*Primary Examiner*—Noah Kamen
(74) *Attorney, Agent, or Firm*—Muncy, Geissler, Olds & Lowe, PLLC

(57) ABSTRACT

The invention relates, in general, to internal combustion engine cooling, in particular for a motor vehicle, more specifically to a cooling agent compensation tank of a cooling circuit, in particular a low-temperature circuit for indirectly cooling a super-charging air for an internal combusting engine and to a method for cooling a highly heated structure, in particular an internal combustion engine. The inventive compensation tank is integrated into a main cooling circuit, wherein a means for directly introducing the cooling fluid is arranged on the compensation tank between the input and output connections and the cooling fluid flow coming into the compensation tank runs directly from the input connection to the output connection by means of said directly introducing means.

36 Claims, 8 Drawing Sheets

COOLING AGENT COMPENSATION TANK FOR A COOLING CIRCUIT

FIELD OF THE INVENTION

The invention generally pertains to the cooling of a highly heated structure such as an internal combustion engine, particularly for a motor vehicle, and specifically to a cooling agent compensation tank for a cooling circuit, particularly for a low-temperature circuit for indirectly cooling supercharging air for an internal combustion engine, to a cooling circuit, particularly a low-temperature cooling circuit for indirectly cooling supercharging air for an internal combustion engine, and to a method for cooling a highly heated structure, particularly an internal combustion engine.

BACKGROUND OF THE INVENTION

Internal combustion engines must be cooled due to the fact that the surfaces in contact with hot gases and their lubricants in the interior of the cylinder can only withstand the occurring temperatures to a certain extent without undergoing damage. Individual components, such as spark plugs, injection nozzles, exhaust gas valves, prechambers and piston heads must be able to withstand particularly high mean temperatures such that components of this type must be made of highly heat-resistance materials or be provided with an adequate heat dissipation mechanism and special cooling means.

Consequently, this heat dissipation is effected by a cooling system, in which a cooling fluid flows through cooling water channels that surround at least the cylinders and the cylinder head in order subsequently to discharge the heat at least partially into the surroundings by means of a radiator or to use the heat to heat, for example, a vehicle interior by means of a heat exchanger.

In this context, the term "cooling agent" should be understood as a collective designation for heat transfer media in different coolers that act to dissipate heat, e.g., for cooling motor vehicle engines, nuclear reactors and chemical reaction apparatus, as well as metals being machined (drilling oil, cutting oil).

Cooling agents may be in the form of gases, liquids or solids.

One frequently used coolant is water, to which is mixed anti-freezing agents, hardness stabilizers, corrosion inhibitors (corrosion) etc.

FIG. 6 shows such a cooling system according to the state of the art, i.e., a cooling circuit 60 for cooling a motor vehicle engine 5.

According to FIG. 6, this cooling circuit 60 features a main circuit or main flow path 61 as well as a secondary circuit or secondary flow path 62, through which the coolant flows in the indicated coolant flow direction 8 in coolant lines 67.

In this case, the internal combustion engine 5 to be cooled, a cooling module 2 used for cooling the coolant, in this case a coolant/air cooler (KM/L-K) 2 with functionally indicated blower 3, as well as a coolant pump 6 for moving the coolant through the cooling circuit, are arranged in the main circuit 61 so that a direct connection between the internal combustion engine 5 and the cooling module 2 is produced in the main circuit 61.

Cooling modules known from the state of the art, for example, from DE 100 18 001 A1 and DE 197 31 999 A1, are modules consisting of several heat transfer elements such as coolant coolers, supercharger intercoolers, condensers or oil coolers that are combined into one structural unit or module, for example, into the coolant/air cooler (KM/L-K) 2 according to the described embodiment, and arranged in a cooling circuit.

FIG. 6 also shows that a large circuit 61*b* in which the coolant flows through the internal combustion engine 5 and through the cooling module 2 during a warm/hot phase of the internal combustion engine 5, as a well as a small circuit in which the coolant only flows through the internal combustion engine 5 during a cold phase of the internal combustion engine 5, are realized within the main circuit 61.

An expansion thermostat 63 arranged between the internal combustion engine 5 and the KM/L-K 2 in the coolant flow direction changes or switches over between the small circuit 61*a* and the large circuit 61*b* when the coolant temperature limit is reached.

A compensation tank (AGB) 70 used, among other things, for eliminating gas from the cooling system (degassing) is arranged in the secondary circuit 62. The compensation tank 63 and the secondary circuit 62 are respectively connected to the main circuit 61 by means of auxiliary lines, namely a degassing line KM/L-K 64, through which the secondary coolant flow is conveyed from the KM/L-K 2 to the AGB 70, and an internal combustion engine degassing line 65, through which a secondary coolant flow is conveyed from the internal combustion engine 5 to the AGB 70, as well as a suction line 66, through which a secondary coolant flow (degassed in the AGB 70) is conveyed back into the main circuit or main flow path 61 from the AGB 70.

It is known that such an AGB 70 fulfills the following functions:

a) it ensures an equalization of coolant expansion and a pressure build-up during the heating of the coolant;

b) the cooling system is filled via the AGB;

c) it serves as a reservoir or a reserve volume for the coolant, and d) the separation of gas from the cooling system (degassing) is realized by the AGB.

This known compensation tank 70 is illustrated separately in FIGS. 7*a-c*.

According to FIGS. 7*a-c*, the AGB 70 consists of a two-part AGB housing 71 that is assembled from a first front housing shell 71*a* and a second rear housing shell 71*b* along a vertical plane of partition.

Horizontal and vertical ribs 80 are respectively arranged in the AGB housing 71 and on the interior sides (not visible) of the first housing shell 71*a* and the second housing shell 71*b* such that several cuboidal chambers 81 are formed within the AGB housing 71. The coolant flow in the AGB 70 is realized through openings 82 in the ribs 80.

According to FIGS. 7*a-c*, a filler neck 72 for filling the cooling system 60 (see function b)) is further provided on the upper left corner of the AGB 70. An outlet connector 74 is arranged diagonally opposite of the filler neck 72, i.e., on the lower right corner of the AGB 70, wherein the suction line 66 is connected to the outlet connector and the degassed coolant flows out of the AGB 70 through said outlet connector.

FIGS. 7*a-c* also show that a pressure relief/suction relief valve 73 is arranged on the AGB 70, approximately in the center of the upper side of the AGB 70, in order to equalize the expansion and build-up of pressure when the coolant is heated (see function a)).

Two ventilating connecting pieces 78, 79 are arranged in the upper region of the right side of the AGB 70, namely a first ventilating connecting piece 78 for the degassing line KM/L-K 64 or connection to it, as well as a second ventilating connecting piece 79 for the internal combustion engine degassing line 65.

A level indicator with a corresponding sensor arrangement 75 is situated underneath the two ventilating connecting pieces 78, 79.

FIG. 7*c* shows that a silica gel reservoir 76 for mixing or adding corrosion inhibitors (corrosion) to the coolant is arranged in the AGB, particularly on the interior side of the first housing shell 71*a*, approximately at the center of the shell.

In order to fix the AGB 70 on the cooling module 2 as shown in FIGS. 7*a-c*, the AGB 70 features two mounting flanges or mounting bolts 70, by means of which the AGB 70 is fixed on a fan cowl or fan housing of the cooling module 2 (not shown).

Here, it should be noted that although it is usually integrated into the cooling module and is included in the parts list, the AGB typically represents an extra component of the cooling circuit.

One disadvantage of this known cooling circuit with a compensation tank arranged in the secondary flow path is the wide variety of required components, for example, several connecting lines and degassing lines that increase the materials outlay and therefore the manufacturing costs, and which may make it impossible to realize a compact design.

In addition, a wide variety of components is usually associated with the increased risk of parts failure.

SUMMARY OF THE INVENTION

The invention is therefore based on the objective of respectively developing a cooling arrangement, particularly for a highly heated structure such as an internal combustion engine, and a cooling circuit, particularly for a low-temperature circuit for indirectly cooling supercharging air in an internal combustion engine, which can be effected in a simpler and more cost-efficient fashion.

This objective is realized with a cooling agent compensation tank of a cooling circuit, particularly for a low-temperature circuit for indirectly cooling supercharging air for an internal combustion engine, with a cooling circuit, particularly a low-temperature cooling circuit for indirectly cooling supercharging air in an internal combustion engine, as well as a method for cooling a highly heated structure, particularly an internal combustion engine.

The invention proposes, in particular, a cooling agent compensation tank for a coolant, particularly for a low-temperature circuit for indirectly cooling supercharging air in an internal combustion engine, wherein said compensation tank features a compensation tank housing with at least one coolant inflow device, through which coolant is able to flow into the compensation tank, and a coolant outflow device, through which coolant is able to flow out of the compensation tank.

An expansion chamber with an expansion chamber coolant inlet device and an expansion chamber coolant outlet device, through which coolant is able to flow into the expansion chamber and out of the expansion chamber, is realized in the compensation tank housing.

In addition, a direct coolant conveying means is arranged on the compensation tank housing in order to connect the coolant inflow device and the coolant outflow device to one another in such a way that at least a partial coolant stream of a coolant stream flowing through the coolant inflow device is able to flow directly from the coolant inflow device to the coolant outflow device without flowing into the expansion chamber.

In this case, the terms "direct" and partial coolant stream flowing directly from the coolant inflow device to the coolant outflow device by means of the direct coolant conveying means should be interpreted in such a way that at least a partial coolant stream of the coolant stream flows or is conveyed from the coolant inflow device to the coolant outflow device without flowing through the expansion chamber coolant inlet device and without being admitted into the expansion chamber or flowing through the expansion chamber.

This direct coolant conveying means makes it possible, in particular, to integrate the inventive compensation tank with a main circuit of a cooling circuit, wherein the conventional secondary circuit, in which the conventional compensation tank is usually arranged, as well as the numerous corresponding lines and connections, can be eliminated.

In this context, the terms "arranged" and "arranged means/devices" should furthermore be interpreted in such a way that these means/devices are separate components or components that are integrated, for example, with the compensation tank housing.

Another particularly advantageous aspect of the invention is that the inventive compensation tank makes it possible to eliminate auxiliary components for the gas separation, for example, the cyclones provided in conventional systems for optimizing gas separation.

It is particularly preferred that the coolant inflow device is realized in the form of an input connection or several input connections, for example, a double connection. It is also particularly preferred that the coolant outflow device is realized in the form of an output connection or several output connections.

The direct coolant conveying means is preferably realized in the form of a tubular flow channel. It is particularly preferred that this tubular flow channel is arranged underneath the expansion chamber.

The expansion chamber coolant inlet device may be realized in the form of a coolant inlet opening that is arranged, in particular, in a lower region of the expansion chamber, for example, a hole or a gap or the like. Accordingly, the expansion chamber coolant outlet device may comprise a coolant outlet opening that is arranged, in particular, in the lower region of the expansion chamber.

It is furthermore possible to arrange the coolant inflow device above the coolant outflow device and/or to arrange the expansion chamber coolant inlet device above the expansion chamber coolant outlet device.

It is particularly preferred that the direct coolant conveying means is realized in the form of an essentially tubular flow channel or several essentially tubular flow channels extending between an input connection or several input connections and an output connection or several output connections.

In addition, the coolant inlet opening and/or the coolant outlet opening may be arranged on an upper side of the direct coolant conveying means, particularly the tubular flow channel.

The tubular flow channel is straight or preferably slightly angled and/or slightly bent, particularly by less than 90°.

It is furthermore possible to arrange the coolant inflow device relative to the coolant outflow device in such a way that the angle of expansion between the coolant inflow device and the coolant outflow device is greater than 90°, particularly greater than 90° and less than 180°.

The compensation tank housing is preferably realized in the form of a two-part housing that is essentially made, in particular, of polypropylene or polyamide and comprises an upper and a lower housing part.

A coolant filling device, particularly a filler neck that can be closed with a screw-type cap, may be arranged on the compensation tank housing in order to fill the compensation tank, particularly the expansion chamber, with coolant.

In addition, the compensation tank, particularly the expansion chamber, may feature a pressure relief/suction relief valve. In this respect, it is particularly relative to integrate the pressure relief/suction relief valve with the coolant filling device, particularly the screw-type cap.

It is furthermore practical to arrange a level indicating device, particularly with a MIN/MAX indicator, in the compensation tank, particularly in the expansion chamber.

The MIN/MAX indicating device is preferably designed in such a way that the coolant level of the coolant lies above the expansion chamber coolant inlet device when a MIN level of the coolant located in the compensation tank, particularly in the expansion chamber, is indicated.

It is furthermore possible to arrange at least one partition means, particularly a vertical partition wall, in the compensation tank, particularly in the expansion chamber, such that the compensation tank, particularly the expansion chamber, can be divided into zones, particularly two zones.

In addition to this partition function, such a partition means, particularly the vertical partition wall, can also be used as splashed water protection and for reinforcing the housing.

It would also be possible to arrange several partition means, for example, vertical and/or horizontal partition walls, in the compensation tank, particularly in the expansion chamber, so as to divide the compensation tank, particular the expansion chamber, into several zones.

In this case, one or more partition means are preferably arranged or realized in the compensation tank, particularly in the expansion chamber, in such a way that a first zone, particularly an inlet zone, is formed in a region of the coolant flow path towards the expansion chamber and/or a second zone, particularly a steady-flow zone, is formed in a region of the coolant flow path from the expansion chamber.

One or more partition means may also be arranged or realized in the compensation tank, particularly in the expansion chamber, in such a way that a coolant exchange and/or a gas exchange can be realized between the zones, particularly between the inlet zone and the steady-flow zone.

For this purpose, at least one opening, particularly two or more openings, may be realized in the one or more partition means for the coolant and/or gas exchange between the zones.

The opening is preferably realized in the form of a hole that is arranged, in particular, in an upper region of the partition means or in the form of a slot that is arranged, in particular, in an upper region of the partition means.

The partition means, particularly a two-part partition means—in accordance with the two-part compensation tank housing—and/or a vertical partition means may furthermore be arranged in the compensation tank housing in such a way that an exchange opening or exchange openings for the coolant and/or gas exchange between the zones is/are provided between an upper edge of the partition means and a compensation tank housing wall and/or between a lower edge of the partition means and a compensation tank housing wall.

It is particularly preferred that the expansion chamber coolant inlet device is arranged downstream of the coolant inflow device relative to the coolant flow direction; it is furthermore preferred that the expansion chamber coolant outlet device is arranged, in particular, upstream of the coolant outflow device relative to the coolant flow direction.

In the region of the expansion chamber coolant inlet device, particularly upstream of the expansion chamber coolant inlet device relative to the coolant flow direction, the coolant inflow device may furthermore be realized in such a way that coolant flowing in this location can expand.

For this purpose, the coolant inflow device may be realized in the form of a diffuser in the region of the expansion chamber coolant inlet device, particularly upstream of the expansion chamber coolant inlet device relative to the coolant flow direction.

This can be achieved, for example, by widening a (flow) cross section of the coolant inflow device in the region of the expansion chamber coolant inlet device, particularly upstream of the expansion chamber coolant inlet device relative to the coolant flow direction.

The compensation tank according to the invention or its additional developments are preferably used in a main circuit, particularly a low-temperature circuit for indirectly cooling supercharging air in an internal combustion engine, through which a main coolant stream flows, in such a way that

- the main coolant stream, particularly with a coolant/gas mixture, flows into the compensation tank through the coolant inflow device,
- at least a partial stream of the inflowing main coolant stream is degassed in the compensation tank, particularly in the expansion chamber, and
- the main coolant stream, particularly with the degassed partial coolant stream, flows out the compensation tank through the coolant outflow device.

The compensation tank according to the invention or its additional developments is also particularly suitable for degassing the coolant. This can be effected in that

- a first main coolant stream, particularly with a coolant/gas mixture, flows into the compensation tank through the coolant inflow device,
- a partial coolant flow of the first main coolant stream flows directly from the coolant inflow device to the coolant outflow device through the direct coolant conveying means,
- another partial coolant flow of the first main coolant stream, particularly with a coolant/gas mixture, flows into the expansion chamber through the expansion chamber coolant inlet device, where it is degassed and flows out of the expansion chamber through the expansion chamber coolant outlet device, and
- a second main coolant stream, particularly with the degassed coolant, which comprises at least partially of the partial coolant stream and the additional partial coolant stream, flows out through the coolant outflow device.

In addition to the highly heated structure, particularly an internal combustion engine, which is arranged in the cooling circuit in order to be cooled by the main coolant stream, there is a cooling module designed to exchange heat with the main coolant stream, particularly a coolant/air cooler, arranged in the inventive cooling circuit, particularly a low-temperature circuit through which a coolant, particularly the main coolant stream, flows in order to cool the highly heated structure, particularly an internal combustion engine of a motor vehicle.

In addition, a compensation tank designed for degassing the main coolant stream, particularly, and preferably, the compensation tank according to the invention or its additional embodiments, is arranged in the inventive cooling circuit.

The compensation tank is arranged in the inventive cooling circuit, particularly downstream of the highly heated structure and/or upstream of the cooling module relative to the coolant flow direction, such that the main coolant stream flows through the compensation tank.

The cooling circuit may furthermore feature a coolant pump that is arranged in the cooling circuit in order to convey the main coolant stream through the cooling circuit.

It is particularly preferred that the highly heated structure, the compensation tank, the cooling module and the coolant pump are arranged in the cooling circuit in such a way that the main coolant stream is able to flow successively through the coolant pump, the cooling module, the highly heated structure and then the compensation tank.

In the inventive method for cooling a highly heated structure, particularly an internal combustion engine, by means of a coolant flowing in a cooling circuit, particularly a low-temperature circuit, the main coolant stream of the cooling circuit flows through a cooling module arranged in the cooling circuit, wherein the main coolant stream is cooled due to the heat exchange between the main coolant stream and the cooling module.

The main coolant stream flows through a compensation tank arranged in the cooling circuit, particularly, and preferably, through the compensation tank according to the invention or its additional embodiments, wherein the main coolant flow is degassed due to the gas separation.

The main coolant stream also flows through the highly heated structure arranged in the cooling circuit, wherein the highly heated structure is cooled due to the heat exchange between the main coolant flow and the highly heated structure.

While flowing through the compensation tank according to the invention or its additional embodiments, it is particularly preferred that

- a first main coolant stream, particularly with a coolant/gas mixture, flows into the compensation tank through the coolant inflow device,
- a partial coolant stream of the first main coolant stream flows directly from the coolant inflow device to the coolant outflow device through the direct coolant conveying means,
- another partial coolant stream of the first main coolant stream, particularly with a coolant/gas mixture, flows into the expansion chamber through the expansion chamber coolant inlet device, where it is degassed and flows out of the expansion chamber through the expansion chamber coolant outlet device, and
- a second main coolant stream, particularly with a degassed coolant, which comprises at least partially of the partial coolant stream and the additional partial coolant stream, flows out through the coolant outflow device.

The invention and other advantages thereof are described below with reference to a non-limiting embodiment, in particular, to a preferred application in a low-temperature circuit for indirectly cooling supercharging air in an internal combustion engine.

DETAILED DESCRIPTION

Figure 5:
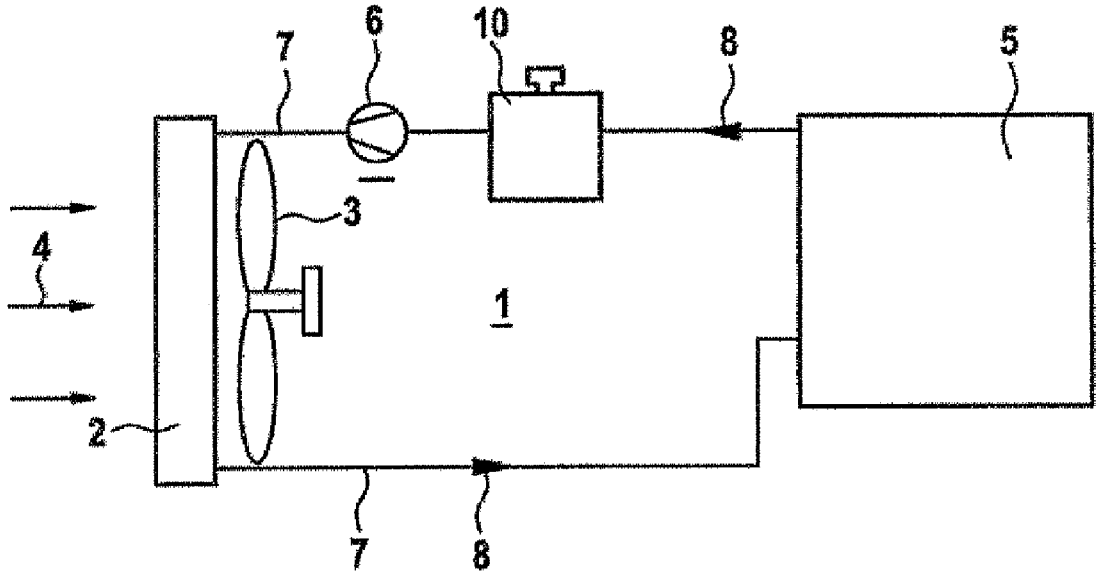
FIG. 5, an inventive low-temperature circuit for indirectly cooling supercharging air in an internal combustion engine of a motor vehicle, with an inventive compensation tank arranged in the main circuit.
Figure 6:
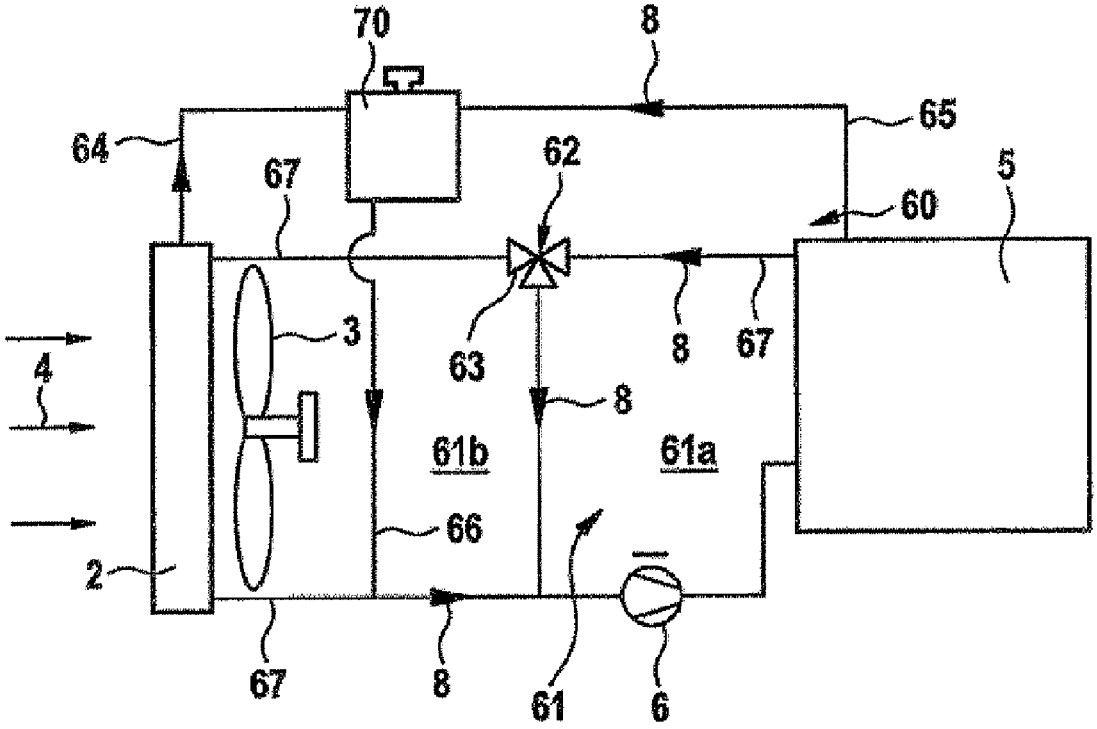
FIG. 6, a conventional cooling circuit for an internal combustion engine of a motor vehicle, wherein a conventional compensation tank is arranged in the secondary flow path in accordance with the state of the art, and FIGS. 7*a-c*, representations of a conventional compensation tank according to the state of the art, for example, for the cooling circuit according to FIG. 6.
Figure 7A:
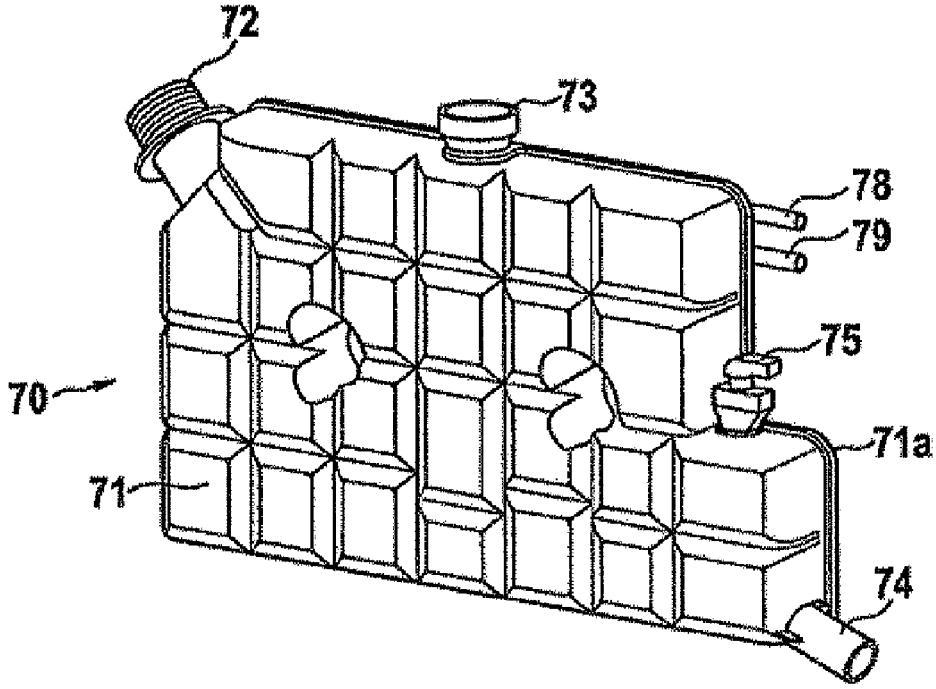
Figure 7B:
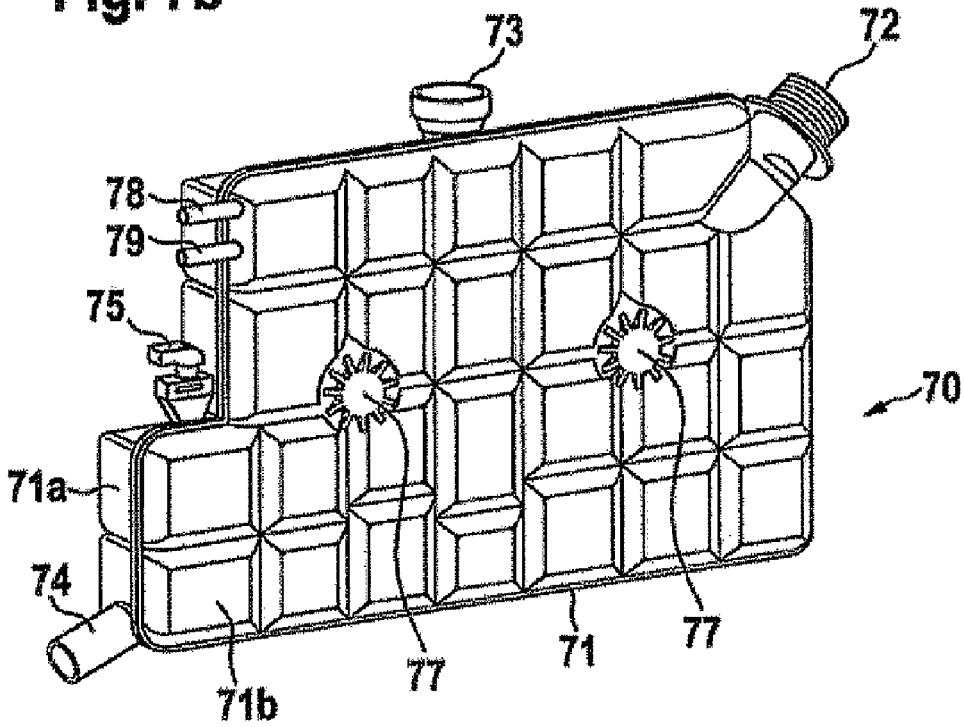
Figure 7C:
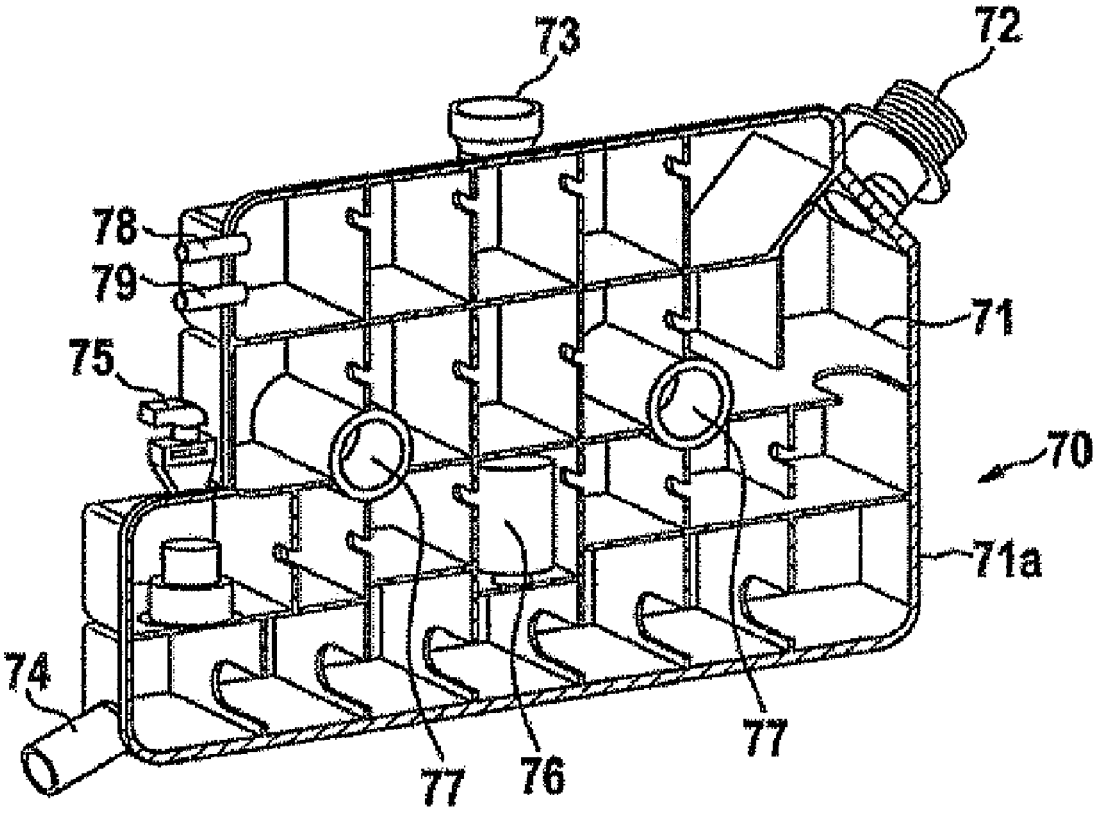

FIG. 5 shows a cooling system 1, namely a low-temperature circuit 1 for indirectly cooling supercharging air in an internal combustion engine 5 of a motor vehicle.

According to FIG. 5, this cooling circuit 1 features only a main circuit 1 or main flow path 1; the coolant, i.e., the main stream, flows through this main circuit 1 (in the indicated coolant flow direction 8 in coolant lines 7).

The internal combustion engine 5 to be cooled, a cooling module 2 used for cooling the coolant, in this case a coolant/air cooler (KM/L-K) 2 with functionally indicated blower 3 and air flow 4, as well as a coolant pump 6 for conveying the coolant in the cooling circuit, are arranged in this main circuit 1.

In the state of the art, for example, according to DE 100 18 0001 A1 and DE 197 31 999 A1, cooling modules are modules that comprise several heat exchangers such as coolant coolers, supercharger intercoolers, condensers or oil coolers that are combined into one structural unit or module, for example, the coolant/air cooler (KM/L-K) 2, and arranged in a cooling circuit.

In addition, a compensation tank (AGB) 10 (FIGS. 1-4) is arranged in the main circuit 1 and is used, among other things, for the separation of gas from the cooling system (degassing).

Although it is mounted on the fan housing 9 and is therefore integrated with the cooling module 2, said AGB 10 represents an extra component of the cooling circuit 1 and is included in the parts list.

According to FIG. 5, the aforementioned components are arranged in the main circuit 1 in such a way that the coolant flows through these components in following sequence: internal combustion engine 5, AGB 10, coolant pump 6, KM/L-K 2.

Alternatively, the AGB 10 could also be arranged downstream of the coolant pump 6.

It is known that AGB 10 fulfills the following functions:

a) it ensures an equalized coolant expansion and pressure build-up during the heating of the coolant;

b) the cooling system is filled via the AGB;

c) it serves as a reservoir or a reserve volume for the coolant, and d) the separation of gas from the cooling system (degassing) is realized with the AGB.

This compensation tank 10, which is integrated with the main circuit 1 by means of an input connection 23, through which the main coolant stream 28 flows into the AGB 10, and an output connection 26, through which the main coolant stream 29 flows out of the AGB 10, as well as the design, flow organization, degassing function and mounting of the AGB 10 on the KM/L-K 2, is illustrated separately and elucidated in FIGS. 1-4.

According to FIGS. 1-4, the AGB 10 is realized in the form of a two-part, polypropylene AGB housing 11 that consists of a first lower housing shell 11*a* and a second upper housing shell 11*b*.

The two housing shells 11*a, b* can be assembled on corresponding partition flanges 12 arranged on the housing shells along an inclined horizontal plane of partition.

Figure 1:
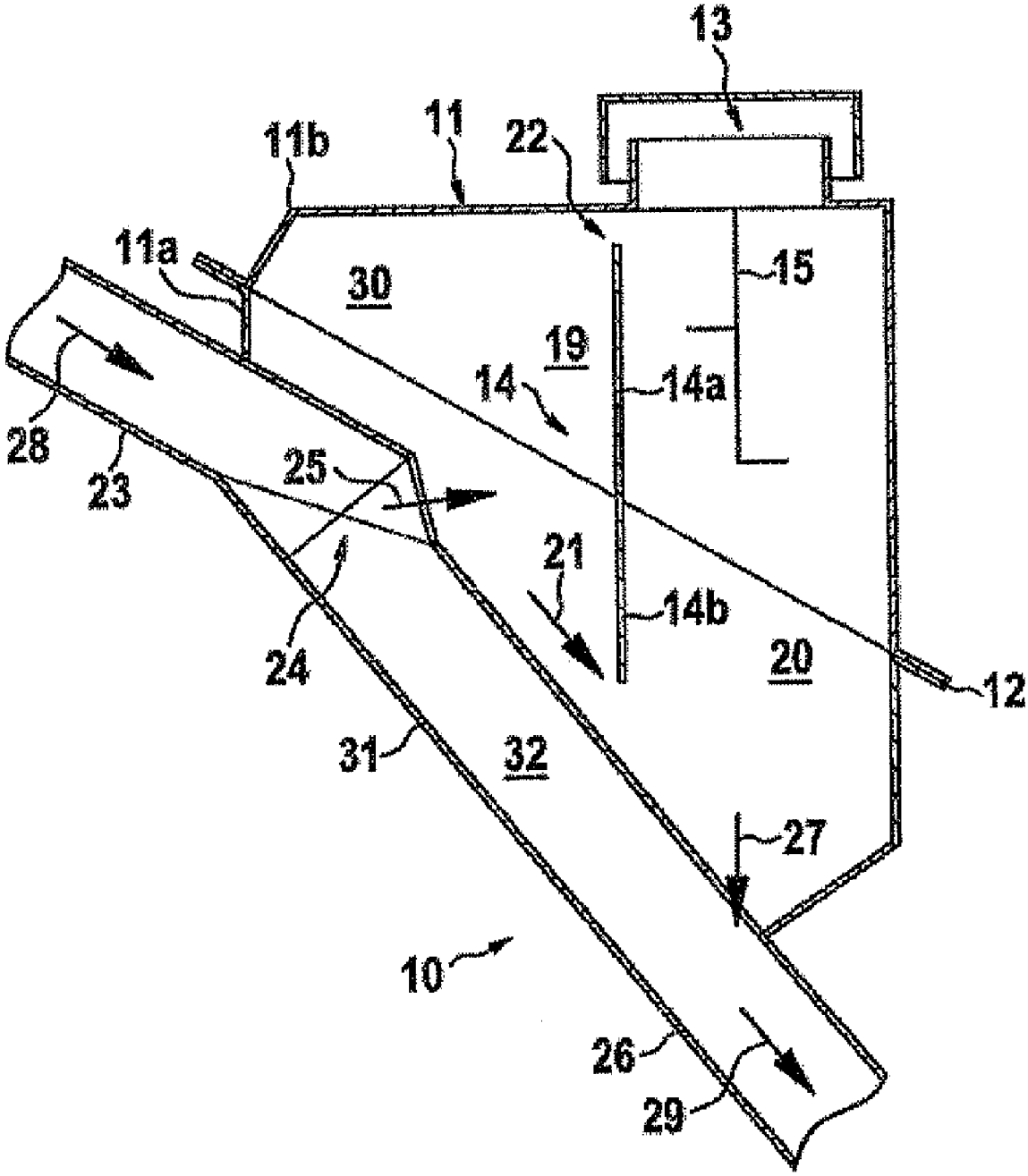
FIG. 1, a schematic section through an inventive compensation tank for a main circuit of a low-temperature circuit for indirectly cooling supercharging air in an internal combustion engine of a motor vehicle.
Figure 2B:
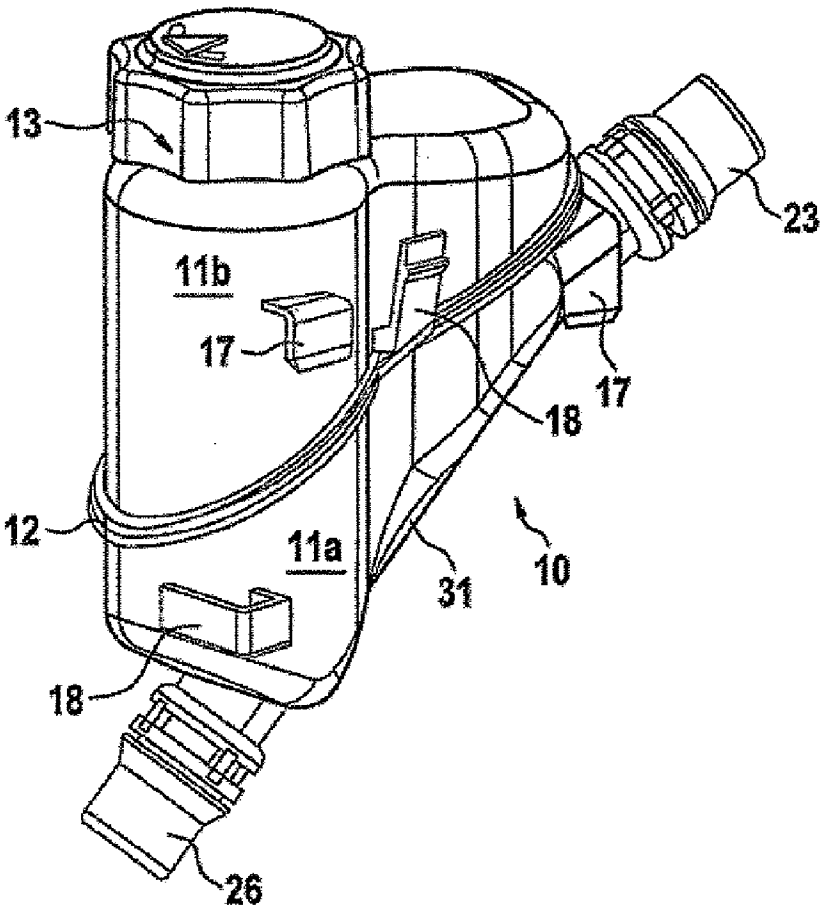
FIGS. 2*a, b*, two representations of an inventive compensation tank for a main circuit of a low-temperature circuit for indirectly cooling supercharging air in an internal combustion engine of a motor vehicle.
Figure 2A:
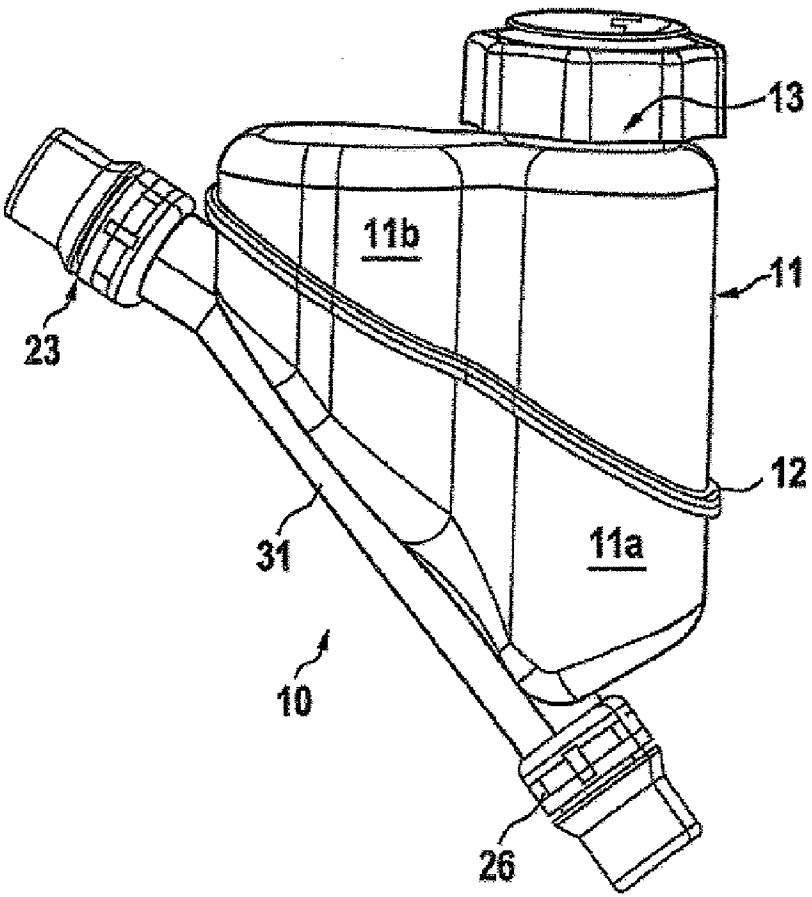
Figure 3A:
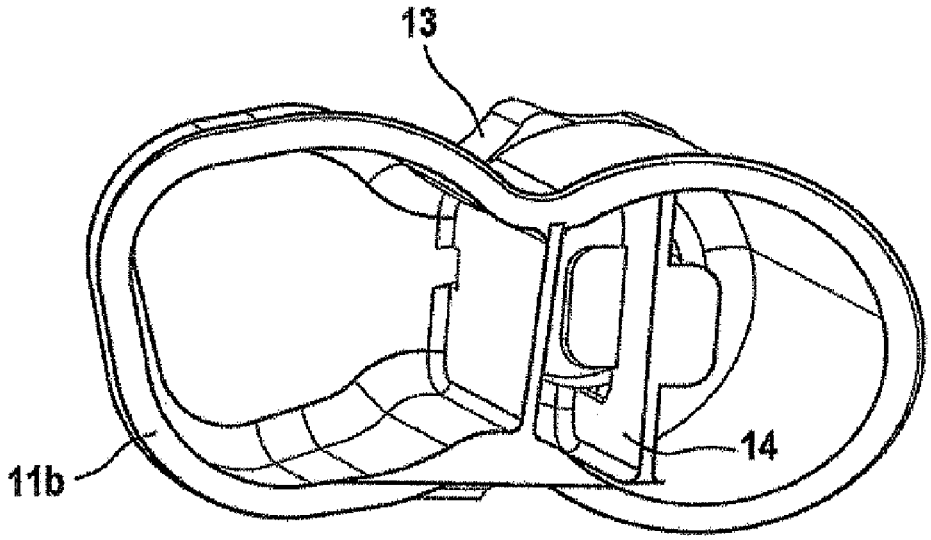
FIGS. 3*a, b*, representations of the housing parts of the inventive compensation tank for a main circuit of a low-temperature circuit for indirectly cooling supercharging air in an internal combustion engine of a motor vehicle.
Figure 3B:
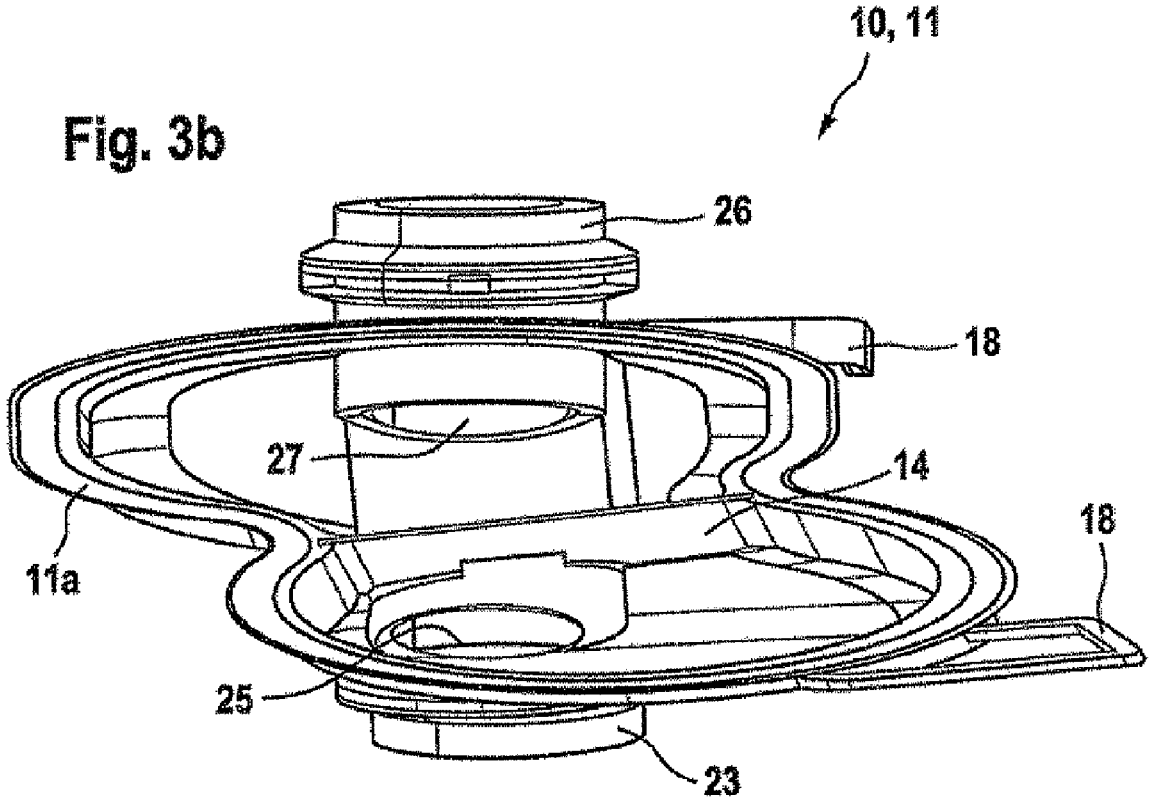
Figure 4A:
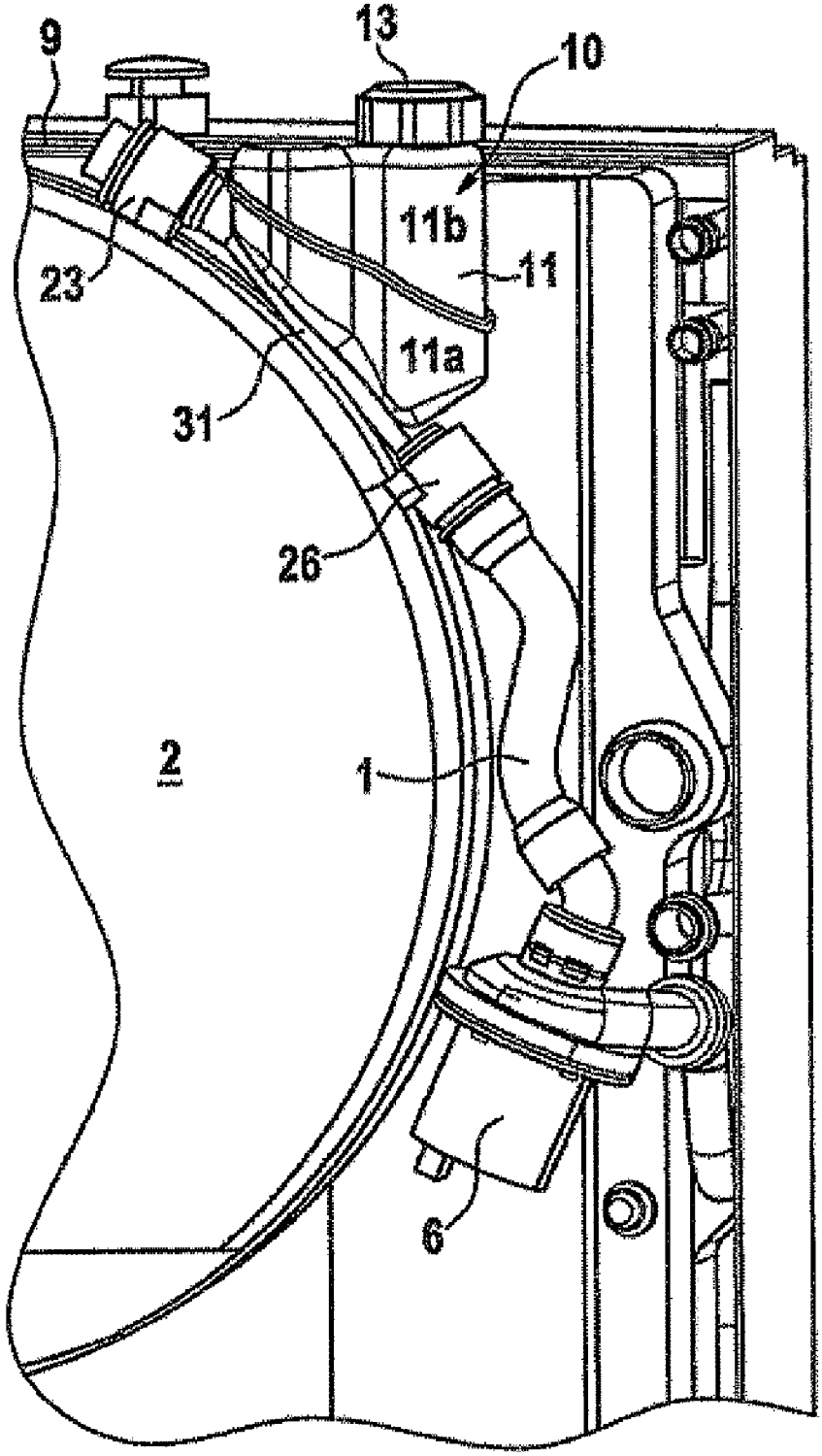
FIGS. 4*a-d*, additional representations of the inventive compensation tank for a main circuit of a low-temperature circuit for indirectly cooling supercharging air in an internal combustion engine of a motor vehicle, which tank is mounted in the cooling module.
Figure 4B:
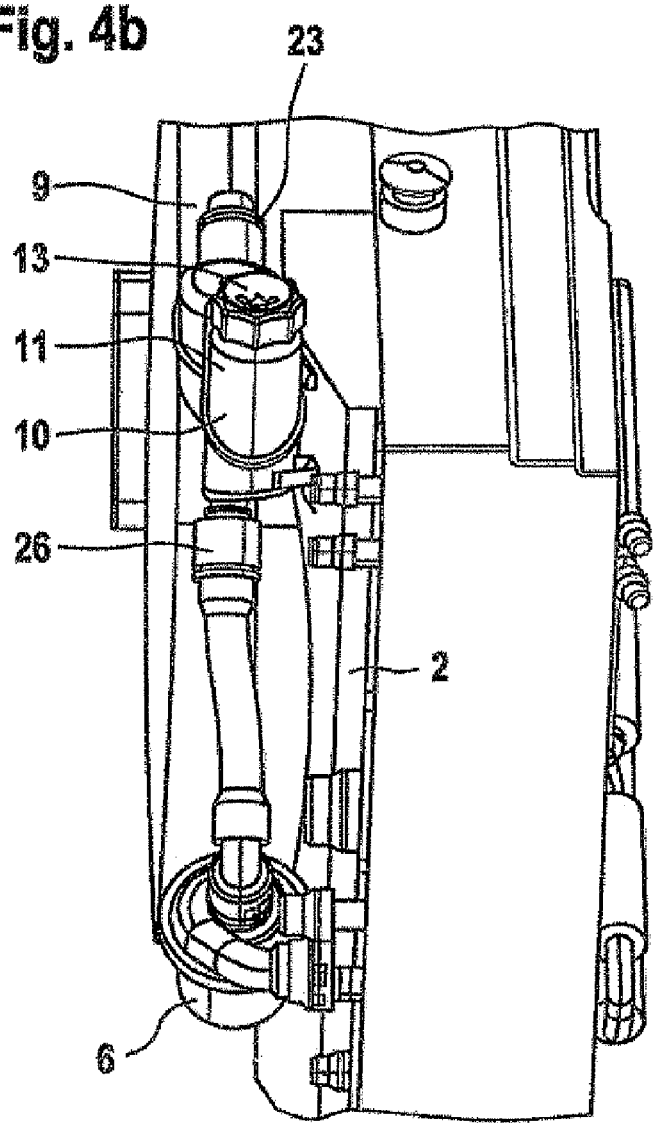
Figure 4C:
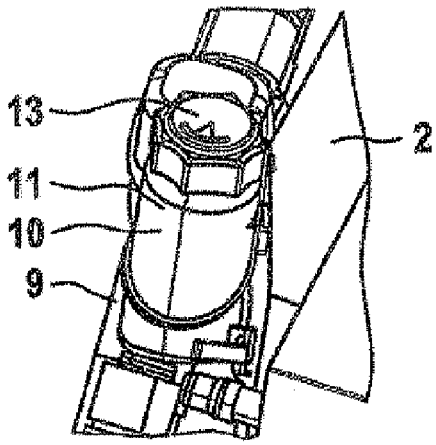
Figure 4D:
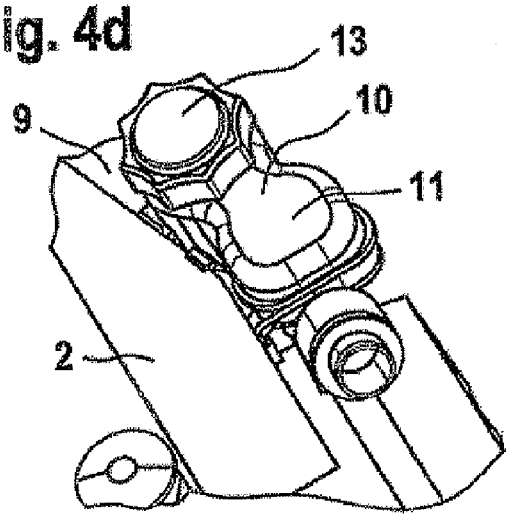

FIG. 1, in particular, shows that said AGB housing 11 forms an interior chamber 30, i.e., an expansion chamber 30, the underside of which contains two openings 25, 27 that form a coolant inlet and a coolant outlet, wherein the coolant or coolant/gas mixture can be degassed in said expansion chamber (see function d)).

The opening 25 forms a coolant inlet opening 25, through which the coolant or the coolant/gas mixture can flow into the expansion chamber 30 (opening for gas separation). The opening 27 forms a coolant outlet opening 27, through which degassed coolant can flow out of the expansion chamber 30 (AGB suction).

According to FIGS. 1-4, the AGB 10 is realized in the form of a two-part, polypropylene AGB housing 11 that comprises a first lower housing shell 11*a* and a second upper housing shell 11*b*.

This tube 31 or direct flow channel 31, as well as the input connection 23 and the output connection 26, are integrated with the AGB housing 11 in this embodiment. However, they could also be realized in the form of separate components to be mounted on the AGB housing 11.

FIG. 1 furthermore shows that the angle of expansion of the tube 31 caused by its angled design lies at approximately 160° in this embodiment.

This direct flow connection 31 between the input connection 23 and the output connection 26 enables the coolant to flow 32 from the input connection 23 to the output connection 26 without flowing into the expansion chamber 30 or flowing through the expansion chamber 30.

These measures, in particular, make it possible to integrate the AGB 10 into the main flow 1.

The main flow 1 (coolant/gas mixture)—that is relative to as the inflowing coolant stream 28 in FIG. 1—then flows through the input connection 23 and into the AGB 10, where it expands in the inlet region of the expansion chamber 30.

A first part of the inflowing coolant stream 28, preferably the coolant/gas mixture located in the upper region of the flow, flows into the expansion chamber 30 through the inlet opening 25 in order to realize the gas separation.

This partial stream is degassed in the expansion chamber 30.

The other part 32 of the inflowing coolant stream 28 flows through the direct channel 31 and then reaches the output connection 26, where it is combined with the degassed partial stream flowing out of the expansion chamber 30 through the outlet opening 27 and then continues to flow in the main circuit in the form of an outflowing coolant stream 29.

FIG. 1, in particular, also shows that the section of a line or flow of the direct channel 31 is widened in a region that lies upstream of the inlet opening 25 (inlet region to the AGB 10)—relative to the flow direction. This means that a diffuser 24 is formed in this region, wherein said diffuser causes the coolant or the coolant/gas mixture to expand at the inlet region to the AGB 10 such that, in particular, the part of the main flow 1 to be degassed (gas mixture) can flow into the AGB 10 and the gas it contains can be eliminated in the AGB 10 (optimized gas separation).

According to FIGS. 1-4, a filler neck 13 is formed on the upper side of the AGB 10 or the AGB housing 11, for filling the cooling system 1 (see function b)). This filler neck 13 can be closed with a screw-type cap, into which a pressure relief/suction relief valve is integrated (see function a)).

A vertical partition wall 14 is arranged within the expansion chamber 30, i.e., approximately at the center of the expansion chamber 30, and serves, among other things, as a splashed water protection and for steadying the flow.

This partition wall 14 comprises an upper partition wall section 14*a* and a lower partition wall section 14*b* that correspond to the two-part AGB housing 11, 11*a*, 11*b* and are integrally connected to the corresponding housing parts 11*a*, 11*b*.

This partition wall 14 divides the expansion chamber 30 into a left zone 19 or inlet zone 19 and a right zone 20 or steady-flow zone 20. In this case, the inlet zone 19 is realized and arranged in such a way that the coolant flows directly into the expansion chamber 30 through the inlet opening 25 at this location. The steady-flow zone 20 lies opposite to the inlet zone 19 and is arranged such that the steadied—and degassed—coolant flows out of the expansion chamber 30 through the outlet opening 27 at this location.

In order to realize a coolant exchange as well as a gas exchange between the zones 19, 20, passage openings 21, 22 in the form of holes or gaps are provided in the upper and lower regions of the partition wall 14, wherein said holes or gaps are realized between the respective upper and lower edges of the partition wall 14 and the AGB housing 11.

Alternatively, it would also be possible to provide several partition walls that form more than two zones and/or provide passage openings that are designed differently, for example, the aforementioned gaps.

FIG. 1, in particular, furthermore shows that a level indicator 15, particularly with a MIN/MAX indicating device and, if applicable, with the corresponding sensor arrangement, is provided in the expansion chamber 30 (see function c)).

The MIN/MAX indicating device 15 is arranged in such a way that the coolant level lies above the coolant inlet opening 25 when the MIN level of coolant located in the expansion chamber 30 is indicated. This ensures that the gas separation can also take place at the minimum coolant level.

A silica gel reservoir 16 (not visible in FIGS. 1-4) is furthermore arranged in the AGB 10 in order to mix or add corrosion inhibitors (corrosion) to the coolant.

FIG. 2*b* and FIGS. 4*a-d*, in particular, show that the mounting of the AGB 10 on the cooling module 2, particularly on the fan housing 9, is realized by providing the AGB 10 with mounting hooks 17, as well as mounting clips 18 or mounting latches 18 for producing corresponding connections with the fan housing 9.

The invention claimed is:

1. A cooling agent compensation tank of a cooling circuit for indirectly cooling supercharging air for an internal combustion engine, comprising a compensation tank housing with at least one cooling agent inflow device, through which a cooling agent is able to flow into the compensation tank, and a cooling agent outflow device, through which the cooling agent is able to flow out of the compensation tank, an expansion chamber with an expansion chamber cooling agent inlet device and an expansion chamber cooling agent outlet device, through which cooling agent is able to flow into the expansion chamber and out of the expansion chamber in the compensation tank housing;

a direct cooling agent conveying device arranged on the compensation tank housing connecting the cooling agent inflow device and the cooling agent outflow device to one another such that at least a partial cooling agent stream of a cooling agent stream flowing through the cooling agent inflow device is able to flow directly from the cooling agent inflow device to the cooling agent outflow device without flowing into the expansion chamber, wherein the direct cooling agent conveying device comprises a straight or slightly angled tubular flow channel.

2. The compensation tank according to claim 1, wherein the cooling agent inflow device comprises an input connection or several input connections and/or the cooling agent outflow device comprises an output connection or several output connections.

3. The compensation tank according to claim 2, wherein the direct cooling agent conveying device comprises a tubular flow channel or several tubular flow channels between at least one input connection and at least one output connection.

4. The compensation tank according to claim 1, wherein the direct cooling agent conveying device arranged underneath the expansion chamber.

5. The compensation tank according to claim 1, wherein the expansion chamber cooling agent inlet device comprises a cooling agent inlet opening arranged in a lower region of the expansion chamber and/or the expansion chamber cooling agent outlet device comprises a cooling agent outlet opening arranged in the lower region of the expansion chamber.

6. The compensation tank according to claim 5, wherein the cooling agent inlet opening and/or the cooling agent outlet opening is/are arranged on an upper side of the direct cooling agent conveying device.

7. The compensation tank according to claim 1, wherein the cooling agent inflow device is arranged above the cooling agent outflow device and/or the expansion chamber cooling agent inlet device is arranged above the expansion chamber cooling agent outlet device.

8. The compensation tank according to claim 1, wherein the tubular flow channel is bent by less than 90°.

9. The compensation tank according to claim 1, wherein the cooling agent inflow device is arranged relative to the cooling agent outflow device such that the angle of expansion between the cooling agent inflow device and the cooling agent outflow device is greater than 90°.

10. The compensation tank according to claim 1, wherein the compensation tank housing comprises an upper and a lower housing part formed of polypropylene or polyamide.

11. The compensation tank according to claim 1, comprising a cooling agent filling device comprising a filler neck that can be closed with a screw-type cap, arranged on the compensation tank housing for filling the expansion chamber with cooling agent.

12. The compensation tank according to claim 1, wherein the expansion chamber includes a pressure relief/suction relief valve.

13. The compensation tank according to claim 1, comprising a pressure relief/suction relief valve, and a cooling agent filling device comprising a screw-type cap, wherein the press relief/suction valve is integrated with the cooling agent filling device.

14. The compensation tank according to claim 1, further comprising a level indicator with a MIN/MAX indicating device, arranged in the expansion chamber.

15. The compensation tank according to claim 14, wherein the MIN/MAX indicating device is arranged such that a cooling agent level of the cooling agent lies above the expansion chamber cooling agent inlet device when a MIN level of the cooling agent located in the expansion chamber, is indicated.

16. The compensation tank according to claim 1, wherein a partition component is arranged in the expansion chamber, wherein said partition component divides the expansion chamber into two zones.

17. The compensation tank according to claim 1, wherein one or more partition components is/are realized or arranged in the expansion chamber, such that an inlet zone is formed in a region in which cooling agent flows into the expansion chamber, and/or a steady-flow zone is formed in a region in which cooling agent flows out of the expansion chamber.

18. The compensation tank according to claim 17, wherein the one or more partition components is/are arranged in the expansion chamber, such that a cooling agent exchange and/or a gas exchange can be realized between the inlet zone and the steady-flow zone.

19. The compensation tank according to claim 18, wherein one or more openings is/are arranged in the one or more partition component in order to realize the cooling agent and/or gas exchange between the zones.

20. The compensation tank according to claim 19, wherein the one or more openings are holes or slots arranged in an upper region of the partition component.

21. The compensation tank according to claim 1, wherein a two-part and/or vertical partition component is arranged in the compensation tank housing such that an exchange opening or exchange openings for the cooling agent and/or gas exchange between the zones is/are formed between an upper edge of the partition component and the compensation tank housing wall and/or between a lower edge of the partition component and the compensation tank housing wall.

22. The compensation tank according to claim 1, wherein the expansion chamber cooling agent inlet device is arranged downstream of the cooling agent inflow device relative to the cooling agent flow direction and/or the expansion chamber cooling agent outlet device is arranged upstream of the cooling agent outflow device relative to the cooling agent flow direction.

23. The compensation tank according to claim 1, wherein the cooling agent inflow device is arranged such that, in the region of the expansion chamber cooling agent inlet device upstream of the expansion chamber cooling agent inlet device relative to the cooling agent flow direction, cooling agent flowing in this location can expand.

24. The compensation tank according to claim 1, wherein the cooling agent inflow device is in the form of a diffuser in the region of the expansion chamber cooling agent inlet device upstream of the expansion chamber cooling agent inlet device relative to the cooling agent flow direction.

25. The compensation tank according to claim 1, wherein a flow cross section of the cooling agent inflow device is widened in the region of the expansion chamber cooling agent inlet device upstream of the expansion chamber cooling agent inlet device relative to the cooling agent flow direction.

26. A cooling circuit through which a main cooling agent stream for cooling an internal combustion engine of a motor vehicle flows, the internal combustion engine, being arranged in the cooling circuit to be cooled by the main cooling agent stream, comprising:

a cooling module, arranged in the cooling circuit for heat exchange with the main cooling agent stream, and the compensation tank according to claim 1, arranged in the cooling circuit for degassing the main cooling agent stream, wherein the compensation tank is arranged in the cooling circuit downstream of the internal combustion engine and/or upstream of the cooling module relative to a cooling agent flow direction, such that the main cooling agent stream flows through the compensation tank.

27. The cooling circuit according to claim 26, comprising a cooling agent pump arranged in the cooling circuit to convey the main cooling agent stream through the cooling circuit.

28. The cooling circuit according to claim 27, wherein the internal combustion engine, the compensation tank, the cooling module and the cooling agent pump are arranged in the cooling circuit such that the main cooling agent stream is able to flow successively through the cooling agent pump, the cooling module, the internal combustion engine and then the compensation tank.

29. A method for cooling an internal combustion engine by means of a cooling agent that flows through a low-temperature cooling circuit, comprising flowing a primary cooling agent stream of the cooling circuit through a cooling module arranged in the cooling circuit and cooling the main cooling agent stream due to the heat exchange between the main cooling agent stream and the cooling module, flowing the main cooling agent stream through the compensation tank according to claim 1, which is arranged in the cooling circuit, and degassing the main cooling agent stream due to gas separation, and flowing the main cooling agent stream through the internal combustion engine arranged in the cooling circuit and cooling the internal combustion engine due to the heat exchange between the main cooling agent stream and the internal combustion engine.

30. The method according to claim 29, comprising flowing the main cooling agent stream through a cooling agent pump that is arranged in the cooling circuit convey the main cooling agent stream through the cooling circuit.

31. The method according to claim 29 wherein during the flow of the cooling agent through the compensation tank the method comprises flowing a first main cooling agent stream with a cooling agent/gas mixture into the compensation tank through the cooling agent inflow device, flowing a partial cooling agent stream of the first main cooling agent stream directly from the cooling agent inflow device to the cooling agent outflow device through the direct cooling agent conveying device, flowing another partial cooling agent stream of the first main cooling agent stream with a cooling agent/gas mixture into the expansion chamber through the expansion chamber cooling agent inlet device, and degassing and flowing the partial cooling agent stream out of the expansion chamber through the expansion chamber cooling agent outlet device, and flowing a second main cooling agent stream with a degassed cooling agent which at least partially comprises the partial cooling agent stream and the additional partial cooling agent stream out through the cooling agent outflow device.

32. A cooling agent compensation tank of a cooling circuit for indirectly cooling supercharging air for an internal combustion engine, comprising a compensation tank housing with at least one cooling agent inflow device, through which a cooling agent is able to flow into the compensation tank, and a cooling agent outflow device, through which the cooling agent is able to flow out of the compensation tank, an expansion chamber with an expansion chamber cooling agent inlet device and an expansion chamber cooling agent outlet device, through which cooling agent is able to flow into the expansion chamber and out of the expansion chamber in the compensation tank housing;

a direct cooling agent conveying device arranged on the compensation tank housing connecting the cooling agent inflow device and the cooling agent outflow device to one another such that at least a partial cooling agent stream of a cooling agent stream flowing through the cooling agent inflow device is able to flow directly from the cooling agent inflow device to the cooling agent outflow device without flowing into the expansion chamber, wherein several partition components are arranged in the expansion chamber, wherein said partition components makes it possible to divide the expansion chamber into several zones.

33. A cooling agent compensation tank of a cooling circuit comprising:

a compensation tank housing having a cooling agent inlet and a cooling agent outlet;

an expansion chamber having an expansion chamber cooling agent inlet and an expansion chamber cooling agent outlet; and a flow channel defining a cooling agent pathway from the cooling agent inlet to the cooling agent outlet, the flow channel being in fluid communication with the expansion chamber cooling agent inlet and the expansion chamber cooling agent outlet, such that a first pathway from the cooling agent inlet to the cooling agent outlet includes the expansion chamber and a second pathway from the cooling agent inlet to the cooling agent outlet bypasses the expansion chamber, wherein a straight line path extends in the flow channel from a first point between the cooling agent inlet and the expansion chamber cooling agent inlet to a second point between the expansion chamber cooling agent outlet and the cooling agent outlet.

34. The cooling agent compensation tank according to claim 33, wherein the flow channel is straight.

35. The cooling agent compensation tank according to claim 33, wherein the flow channel is slightly bent.

36. The cooling agent compensation tank according to claim 33, wherein the flow channel is bent by less than 90°.

* * * * *